United States Patent [19]

Matsuzaki et al.

[11] Patent Number: 4,993,971

[45] Date of Patent: Feb. 19, 1991

[54] EMI RESISTANT ELECTRICAL CONNECTOR

[75] Inventors: Shuichi Matsuzaki; Shigeru Kikuta, both of Tokyo, Japan

[73] Assignee: Hirose Electric Co., Ltd., Tokyo, Japan

[21] Appl. No.: 503,138

[22] Filed: Apr. 2, 1990

Related U.S. Application Data

[63] Continuation of Ser. No. 315,583, Feb. 27, 1989, abandoned.

[30] Foreign Application Priority Data

Mar. 7, 1988 [JP] Japan ..... 63-53288

[51] Int. Cl.[5] ..... H01R 13/648

[52] U.S. Cl. ..... 439/607

[58] Field of Search ..... 439/607, 608, 609, 610, 439/92, 101, 108, 676

[56] References Cited

U.S. PATENT DOCUMENTS

| | | | |
|---|---|---|---|
| 3,171,706 | 3/1965 | Daniels et al. | 439/609 |
| 4,571,012 | 2/1986 | Bassler et al. | 439/607 X |
| 4,611,878 | 9/1986 | Hall et al. | 439/610 |
| 4,619,493 | 10/1986 | Kikuta | 439/607 X |
| 4,653,825 | 3/1987 | Olsson | 439/607 X |
| 4,718,866 | 1/1988 | Yamaguchi | 439/607 |

FOREIGN PATENT DOCUMENTS

| | | |
|---|---|---|
| 57-56476 | 12/1982 | Japan . |
| 60-21906 | 6/1985 | Japan . |

*Primary Examiner*—Neil Abrams
*Assistant Examiner*—Khiem Nguyen
*Attorney, Agent, or Firm*—Kanesaka & Takeuchi

[57] ABSTRACT

An electgromagnetic interference resistant electrical connector consisting of an electrical plug and an electrical receptacle. The electrical plug includes an insulating housing having a floor portion which defines a fitting cavity; first contact elements arranged on a surface of the floor portion such that their contact sections are exposed in the fitting cavity; first shield plate provided on the other surface of the floor portion; and second shield plate provided above the contact sections to cover the fitting cavity. The electrical receptacle includes an insulating housing having contact support plate; second contact elements arranged on the contact support plate such that their contact sections are exposed in the fitting cavity; and a shield case having a ceiling portion close to the contact support plate and a floor portion opposed to the second contact sections such that when both the electrical plug and receptacle are connected to each other, the first and second contact sections are brought into contact with each other in the fitting cavity, and the first and second shield plate are brought into contact with the ceiling and floor portion of the shield case, respectively, so as to enclose both the floor portion and the contact support plate.

5 Claims, 2 Drawing Sheets

EMI RESISTANT ELECTRICAL CONNECTOR

This application is a continuation of U.S. patent application Ser. No. 315,583 filed Feb. 27, 1989 now abandoned.

BACKGROUND OF THE INVENTION

The present invention relates generally to electromagnetic interference (EMI) resistant electrical connectors and, more particularly, to a thin or low height type EMI resistant electrical connector.

Japanese U.M. Patent Application Publication No. 60-21906 discloses an EMI resistant electrical connector. This electrical connector includes a pair of shield case sections for enclosing the contact section to thereby provide an EMI countermeasure.

However, this electrical connector has the following shortcomings.

(1) The insulator housings of its plug and receptacle are large, and the shield members surrounding them are thick increasing the size of the electrical connector.

(2) Its structure is so complicated and the numbers of components and process steps are so large that it becomes very expensive.

(3) Its shield member is so thick that its height from the printed circuit board (PCB) is too large to meet the miniaturization requirement.

(4) The opening of its plug is so large that a finger can enter easily and contact its contact elements failing to provide a complete static countermeasure.

Japanese U.M. Patent Application Publication No. 57-56476 discloses a thin type electrical connector to be mounted on a PCB. This electrical connector includes a pair of insulating housing sections cut at the contact section so that the thickness of the electrical connector is reduced.

However, this electrical connector has the following shortcomings.

(1) It has no EMI countermeasure.

(2) The terminals of its connector case are not resilient at all so that the force of plugging in or out a multi-contact electrical connector of this type becomes too large to permit easy operation.

(3) The contacts of its plug case are made of wire so that the area of electrical contact with the terminals of its connector case is very small, limiting its current capacity.

(4) The contact elements of its plug case, when not used, are almost completely exposed so that an object can strike a contact element making it deformed, broken, or short-circuit. Also, a finger can easily come to contact with a contact element thereby applying static electricity thereto, resulting in a circuit breakdown.

SUMMARY OF THE INVENTION

Accordingly, it is an object of the present invention to provide an EMI resistant electrical connector free of the above problems.

According to the invention there is provided an electromagnetic interference resistant electrical connector consisting of an electrical plug and an electrical receptacle, the electrical plug including an insulating housing having a pair of side walls and a floor portion which define a fitting cavity with a substantially C-shaped cross section; a plurality of first contact elements arranged on a surface of the floor portion such that their contact sections are exposed in the fitting cavity; first shield plate provided on the other surface of the floor portion; and second shield plate provided above the contact sections to cover the fitting cavity; and the electrical receptacle including an insulating housing having contact support plate; a plurality of second contact elements arranged on the contact support plate such that their contact sections are exposed in the fitting cavity; and a shield case having a ceiling portion close to the contact support plate and a floor portion opposed to the second contact sections such that when both the electrical plug and receptacle are connected to each other, the first and second contact sections are brought into contact with each other in the fitting cavity, and the first and second shield plate are brought into contact with the ceiling and floor portion of the shield case, respectively, so as to enclose both the floor portion and the contact support plate.

Other objects, features, and advantages of the present invention will be apparent from the following description taken in conjunction with the accompanying drawings.

DESCRIPTION OF THE PREFERRED EMBODIMENT

Figure 1:
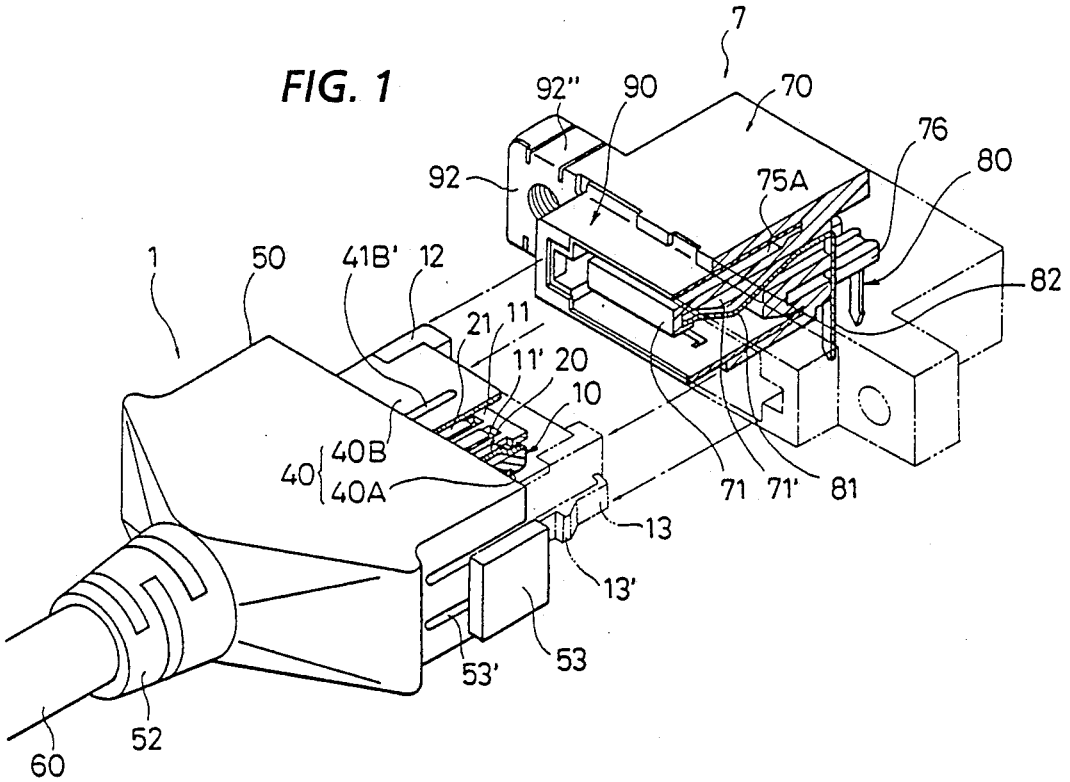
FIG. 1 is a perspective view of an electrical connector according to an embodiment of the invention.
Figure 2:
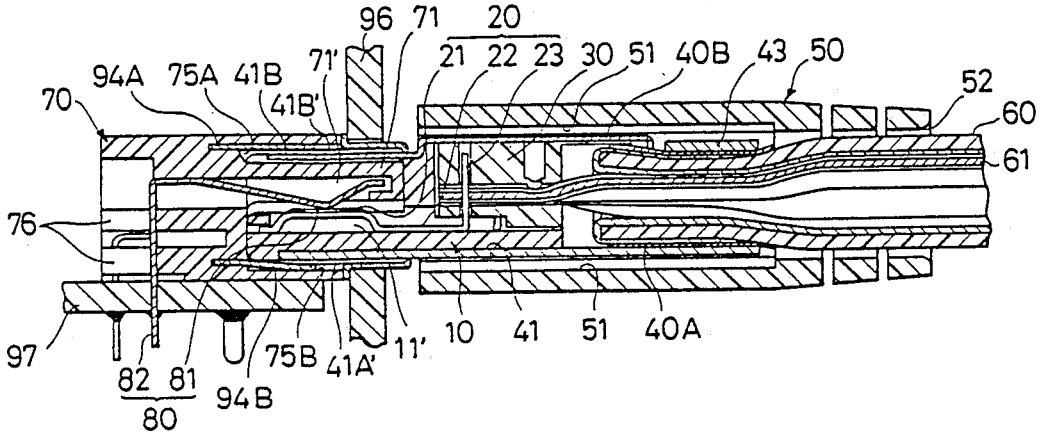
FIG. 2 is a sectional view of the electrical connector of FIG. 1.

In FIGS. 1 and 2, an electrical connector plug 1 includes an insulating housing 10, a number of contact elements 20, a shield case 40, and a cover case 50. The insulating housing 10 is made from an insulator, such as a plastic, so as to have a floor portion and a pair of side walls 12 which define a fitting cavity 11. A lock arm 13 with a lock projection 13' is provided on the outside of each side wall 12. A number of contact channels 11' are provided on the floor portion of the insulating housing 10 across the side walls 12.

The contact element 20 is made from spring sheet metal and arranged in the contact channel 11' such that its contact section 21 is exposed in the fitting cavity 11 as shown in FIG. 2. It has a piercing section 23 connected to an insulated conductor 61 of a cable 60 by insulation piercing or displacement. The contact section 21 and the piercing section 23 are integrated via an intermediate section 22.

The shield case 40 is made from non-spring, conductive sheet metal, such as brass, and its surfaces may be plated with solder. It is divided into a lower shield plate 40A and an upper shield plate 40B. The lower shield plate 40A has a cable clamp 43 and a housing support 41 with a number of elongated bosses 41A' arranged widthwise. The upper shield plate 40B has a fitting plate 41B with a number of elongated bosses 41B' therein.

The cover case 50 is made from an insulator, such as a plastic, so as to have a unit cavity 51, a cable outlet 52, a push button 53, and a pair of parallel slits 53' for permitting the push button 53 to flex.

As best shown in FIG. 2, a guide block 30 is provided to arrange the insulated conductors 61 of a cable 60 for facilitating connection by insulation piercing.

Figure 3:
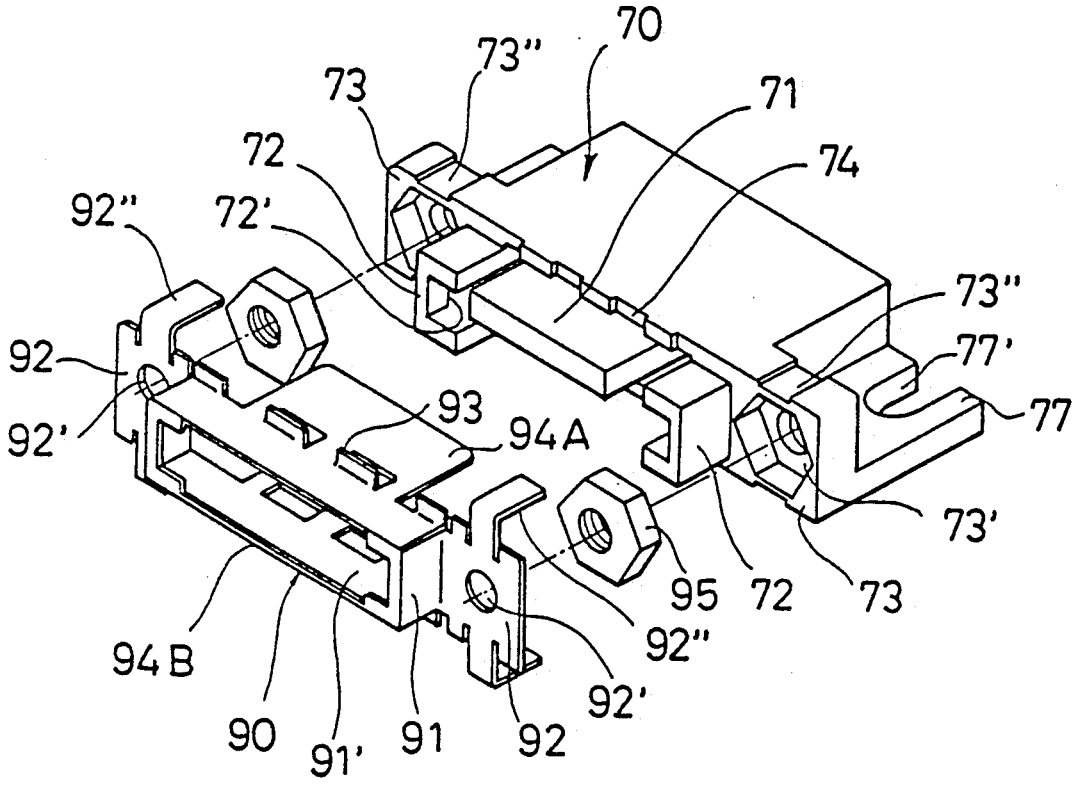
FIG. 3 is an exploded perspective view of the electrical connector receptacle of FIG. 1.

In FIG. 3, an electrical connector receptacle 7, which is to be mounted on a PCB, includes an insulating housing 70, contact elements 80 (FIG. 2), and a shield case 90. The insulating housing 70 includes a contact support plate 71 with a number of contact channels 71' in which contact elements 80 are arranged, a pair of retention columns 72 which hold the shield case and have an engaging shoulder 72' on the inside, a pair of mounting walls 73 which have a hexagonal recess 73' for receiving a nut 95 and a pair of mounting grooves 73", a plurality of receiving notches 74, a pair of receiving recesses 75A and 75B for receiving the shield case, a plurality of channels 76 for receiving the connection sections of contact elements, and a pair of horizontal flanges 77 with a notch 77' for receiving a screw.

As shown in FIGS. 1 and 2, the contact element 80 has a contact section 81 to be placed in the contact channels 71' on the contact plate 71 and a connection section 82 to be connected to a conductor of a PCB 97.

The shield case 90 is made from conductive sheet metal so as to have a fitting section 91 with a fitting opening 91', a pair of mounting sections 92 with a mounting hole 92' and a pair of retention tabs 92", and a pair of flat sections 94A and 94B with a plurality of erected ears 93. The shield case 90 may be attached to the insulating housing 70 by inserting the rear portions of the respective flat sections 94A and 94B into the corresponding recesses 75A and 75B so that the respective ears 93 engage the corresponding notches 73".

As shown in FIG. 2, the electrical connector receptacle 7 is mounted on the PCB 97 such that the fitting opening 91' is exposed through an opening of a shield equipment panel 96. When the electrical connector plug 1 is fitted into the electrical connector receptacle 7, the contact sections 21 of contact elements 20 come to contact with the corresponding contact sections 81 of contact elements 80. Simultaneously, the front end of the lower plate 40A of the shield case is inserted into the fitting section of the shield case 90 and electrically connected to the shield case 90 via the elongated bosses 41A'. Similarly, the front end of the upper plate 40B is inserted between the fitting section 91 and the contact plate 71 and electrically connected to the shield case 90 via elongated bosses 41B'. Consequently, the contact section of the contact elements 20 and 80 are enclosed completely by the insulating plates of the insulating housings 10 and 70 and shield cases 40 and 90.

The EMI resistant electrical connector according to the invention has the following advantages.

(1) Its shield members are made from sheet metal which is sufficiently thin to provide a compact connector.

(2) Its structure is simpler than that of the prior art and the number of components is reduced so that the number of process steps and the unit manufacturing cost are reduced.

(3) It is easy to give a spring property to the contact sections of contact elements for its plug and its receptacle so that the force of plugging in or out is small even for a connector with a great number of contacts.

(4) The contact elements of its plug and its receptacle are made from sheet metal and the housing is so thin that the thickness or height of the connector from the PCB on which the connector is mounted is much smaller than that of the conventional EMI resistant connector.

(5) The fitting openings of its plug and its receptacle are made so as to enclose completely the contact elements so that no object strikes a contact element causing damage or short-circuiting. Each opening may be made thinner than a finger thereby eliminating the possibility of the finger coming to contact with a contact element within the opening. Even if a finger contacts the opening, the shield case protects the circuitry from the static electricity of the human body.

While a preferred embodiment of the invention has been described using specific terms, such description is for illustrative purposes only, and it is to be understood that changes and variations may be made without departing from the spirit and scope of the invention as recited in the following claims.

What is claimed is:

1. A thin electromagnetic interference resistant electrical connector receptacle to be mounted on a planar panel or printed circuit board, which comprises:

a substantially rectangular, low insulating housing having a flat ceiling, side walls, and a flat floor, said insulating housing including:

a pair of mounting walls extending laterally from a front end thereof, a pair of retention columns extending forwardly from said front end, and a contact support plate extending forwardly from a rear end thereof beyond front edges of said flat ceiling and floor substantially up to front ends of said retention columns to form an upper space and a lower contact space;

a plurality of contact elements arranged on said contact support plate, each contact element having a lateral contact section placed on said contact support plate and a vertical connection section extending downwardly from said contact section for connection to a conductor of said printed circuit board;

a substantially rectangular shield case having an upper surface, low side walls, and a lower surface to define a substantially rectangular fitting section with a substantially rectangular fitting opening for receiving an electrical connector plug, said shield case including:

a first flat section extending backwardly from said upper surface thereof into said insulating housing between said flat ceiling and said contact support plate, and a second flat section extending backwardly from said lower surface thereof into said insulating housing, said fitting section fitted over said retention columns to completely shield contact sections of said contact elements.

2. A thin electromagnetic interference resistant electrical connector plug comprising:

a low insulating housing having a pair of low side walls and a floor portion extending between said side walls to define a low fitting cavity, said low side walls extending substantially up to a front edge of said floor portion;

a plurality of contact elements arranged on a surface of said floor portion such that their contact sections are exposed in said fitting cavity;

first shield plate means provided on the other surface of said floor portion to support said insulating housing;

second shield plate means supported by said low side walls to cover said contact sections in said fitting cavity; and a cover case for covering a rear portion of said first and second shield plate means so that a front portion of each shield plate means is exposed outside when said connector plug is in an unplugged state.

3. The thin electromagnetic interference resistant electrical connector plug of claim 2, wherein said floor portion has a plurality of contact channels thereon for receiving said contact elements, one for each channel, said contact channels terminating in front of a front end of said floor portion so that a tip of each said contact element is covered by said front end.

4. The thin electromagnetic interference resistant electrical connector plug of claim 2, wherein said contact elements each have a connection section and an intermediate section in addition to said contact section which has a flattened C-shaped form.

5. A thin electromagnetic interference resistant electrical connector consisting of a thin electrical plug and a thin electrical receptacle for mounting on a planar panel or printed circuit board, said electrical plug comprising:

a low insulating housing having a pair of low side walls and a floor portion extending between said side walls to define a fitting cavity, said low side walls extending substantially up to a front end of said floor portion;

a plurality of first contact elements arranged on a surface of said floor portion such that their contact sections are exposed in said fitting cavity;

first shield plate means provided on the other surface of said floor portion extending forwardly substantially up to said front end of said floor portion for supporting said insulating housing; and second shield plate means extending forwardly above said contact sections substantially up to said front end of said floor portion to cover said fitting cavity; and said electrical receptacle comprising:

a substantially rectangular, low insulating housing having a pair of retention columns extending forwardly from a front end thereof and contact support plate means extending forwardly beyond said front end substantially up to front ends of said retention columns;

a plurality of second contact elements arranged on said contact support plate means such that their contact sections are exposed in said fitting cavity so that they come into contact with first contact elements when said electrical plug and receptacle are joined, and a shield means having an upper surface, low side walls, and a lower surface to define a substantially rectangular fitting section fitted over said retention columns and a first flat section extending rearwardly from said upper surface in a close relation to said contact support plate means and a second flat section extending rearwardly from said lower surface in an opposed relation to said second contact sections such that when both said electrical plug and receptacle are connected to each other, said first and second contact sections are brought into contact with each other in said fitting cavity, and said first and second shield plate means are brought into contact with said first flat section between said first flat section and said contact support plate means and said second flat section of said shield means respectively.

* * * * *